US010683778B2

(12) United States Patent
Baltrucki et al.

(10) Patent No.: US 10,683,778 B2
(45) Date of Patent: Jun. 16, 2020

(54) REMOVABLE VALVE BRIDGES AND VALVE ACTUATION SYSTEMS INCLUDING THE SAME

(71) Applicant: Jacobs Vehicle Systems, Inc., Bloomfield, CT (US)

(72) Inventors: Justin D Baltrucki, Canton, CT (US); G. Michael Gron, Jr., Granby, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 15/692,773

(22) Filed: Aug. 31, 2017

(65) Prior Publication Data

US 2018/0058271 A1 Mar. 1, 2018

Related U.S. Application Data

(60) Provisional application No. 62/381,580, filed on Aug. 31, 2016.

(51) Int. Cl.
*F01L 1/26* (2006.01)
*F01L 13/06* (2006.01)
(Continued)

(52) U.S. Cl.
CPC ..... *F01L 1/26* (2013.01); *F01L 1/02* (2013.01); *F01L 1/18* (2013.01); *F01L 13/06* (2013.01); *F01L 2820/03* (2013.01)

(58) Field of Classification Search
CPC ..... F01L 1/26; F01L 1/02; F01L 1/18; F01L 13/06; F01L 2820/03; F01L 1/08; F01L 13/065; F02D 13/02; F02D 13/06
(Continued)

(56) References Cited

U.S. PATENT DOCUMENTS 8,851,048 B2 10/2014 Meistrick
2002/0124822 A1* 9/2002 Cornell ..... F01L 1/20 123/90.22

(Continued)

FOREIGN PATENT DOCUMENTS

CN 105888760 A * 8/2016
JP S61006611 U 1/1986
WO 2016118548 A1 7/2016

OTHER PUBLICATIONS

International Search Report for International Application No. PCT/US17/049684, dated Dec. 13, 2017, 3 pages.

(Continued)

*Primary Examiner* — Devon C Kramer
*Assistant Examiner* — Kelsey L Stanek
(74) *Attorney, Agent, or Firm* — Moreno IP Law LLC

(57) ABSTRACT

A system for actuating engine valves may include a valve bridge having a main event rocker interface portion, a first valve interface portion and a second valve interface portion extending in generally opposite directions from the main event rocker interface portion. The second valve interface portion may include an open end including a slot for receiving a bridge pin. The slot permits the valve bridge to be removed from the actuation system without removal of the main event rocker or other actuating components, such as an auxiliary rocker. The valve bridge can be removed from the valve train without requiring removal of other actuation system components, such as auxiliary rockers or main event rockers. A single valve bridge configuration can be used with different valve spans, which may occur among different cylinder sizes in a given engine family, or across different engine families.

19 Claims, 9 Drawing Sheets

(51) Int. Cl.
*F01L 1/02* (2006.01)
*F01L 1/18* (2006.01)

(58) Field of Classification Search
USPC ..... 123/90.22, 90.15, 90.1, 90.39, 90.4, 123/90.44, 90.45, 90.6, 90.16; 74/567, 74/569, 559
See application file for complete search history.

(56) References Cited

U.S. PATENT DOCUMENTS

2012/0298057 A1* 11/2012 Janak ..... F01L 13/06 123/90.12
2013/0098319 A1* 4/2013 Methley ..... F01L 1/14 123/90.12
2014/0083381 A1* 3/2014 Roberts ..... F01L 1/08 123/90.15
2014/0109848 A1 4/2014 Janak
2014/0326212 A1 11/2014 Baltrucki et al.
2015/0354418 A1 12/2015 Jo
2017/0241305 A1* 8/2017 Xi ..... F01L 13/06
2017/0321576 A1* 11/2017 Nielsen ..... F01L 1/2416
2018/0163578 A1* 6/2018 Kim ..... F01L 1/08
2019/0145289 A1* 5/2019 Ferreira ..... F01L 1/255 123/90.55

OTHER PUBLICATIONS

Written Opinion of the ISA for International Application No. PCT/US17/049684, dated Dec. 13, 2017, 9 pages.
Supplementary European Search Report for European Patent Application No. 17847569 dated Feb. 13, 2020, 9 pages.

* cited by examiner

REMOVABLE VALVE BRIDGES AND VALVE ACTUATION SYSTEMS INCLUDING THE SAME

PRIORITY CLAIM AND REFERENCE TO RELATED APPLICATION

This application claims priority and benefit under all applicable laws, treaties and regulations, to U.S. provisional application Ser. No. 62/381,580 filed on Aug. 31, 2016, titled "BRIDGE SYSTEM WITH BRIDGE PIN IN OPEN SLOT." The subject matter of this application is incorporated herein by reference in its entirety.

BACKGROUND

1. Technical Field

The disclosure relates generally to valve actuation system components and valve actuation systems used in internal combustion engines.

2. Prior Art

Internal combustion engines typically incorporate a number of valves for cyclically controlling intake and exhaust of combustion components from a combustion chamber, which is typically defined by a movable piston and cylinder arrangement. In addition to intake and exhaust valves, auxiliary valves may be provided to support auxiliary valve events related to different respective engine functions. Engines may include multiple intake valves, multiple exhaust valves and multiple auxiliary valves for each cylinder. Cams and rocker elements actuate and control valve position to achieve desired engine functions. Moreover, the prior art includes actuation systems for controlling and actuating each of the multiple valves differently to achieve different engine power objectives. These power objectives may include positive power, where the engine generates power to a vehicle drive train to propel the vehicle through the combustion of fuel. Power objectives may also include engine braking or retarded power, where the unfueled engine acts as an air compressor to absorb energy from a vehicle drive train in a vehicle engine braking action, for example.

When multiple valves, such as multiple exhaust valves for a single cylinder are used, valve sets in the primary combustion cycle are actuated at about the same time. Valve bridges are often used to actuate valve sets with a common rocker arm and thereby reduce the number of valve actuation components, i.e., camshafts, cam lobes and rocker arms, that are required to actuate the engine valves. A valve bridge typically includes two arms that extend from a central rocker interface portion and between the stem ends of the valves in a valve set, thereby forming a T-shape.

U.S. Pat. No. 8,851,048 to Meistrick describes engine valve actuator systems that are typical of prior art systems and which may utilize valve bridges. These components provide for actuation of a valve set of two or more valves by transmitting motion from a main event (i.e., the primary combustion cycle) rocker to the valves. In addition, one of the valves in the valve set may be separately actuated by an auxiliary rocker to achieve different power objectives, such as engine braking, exhaust gas recirculation or brake gas recirculation. Separate actuation of one of the valves is facilitated by a bridge pin, which is mounted within the valve bridge for movement in a valve axial direction. The subject matter of U.S. Pat. No. 8,851,048 is incorporated herein by reference in its entirety.

FIG. 1 illustrates details of another prior art valve bridge and bridge pin assembly 10. The valve bridge 20 includes a central main event rocker section 30, a first valve interface portion 40 and a second valve interface portion 50. The first valve interface portion 40 includes a channel 42 for receiving a first valve stem (not shown in FIG. 1). The second valve interface portion 50 surrounds a bridge pin 60 having a second valve engaging pocket 62 on one end and a post 64 extending in an opposite direction and having a reduced diameter compared to the base of the bridge pin having pocket 62. Post 64 extends within a correspondingly sized retaining hole extending thru the second valve interface portion 50. A snap ring 66 retains the bridge pin 60 within the valve bridge 20 for limited axial movement relative thereto. An auxiliary rocker may thus separately actuate the bridge pin 60 and associated second valve (not shown in FIG. 1) relative to the main event actuation of the entire valve bridge 20 by a main event rocker.

As will be recognized, engines and associated valve actuation systems become more complex as the number of desired engine power objectives and functions increases. The prior art suffers from a number of disadvantages relating to this complexity. The servicing, maintenance and repair of engines that include such actuation systems becomes more involved and expensive. For example, servicing of fuel injectors may be required periodically for many diesel engines and typically requires removal of at least parts of the valve actuation assembly, including the valve bridge, which in turn, requires removal of the entire rocker assembly and rocker shaft on prior art systems. Needless to say, such servicing of fuel injectors and other components in prior art systems can therefore require extensive time and labor and associated increases in costs.

Another disadvantage with prior art actuation systems and components is that parts for a given valve actuation system, such as valve bridges, must be fabricated precisely for a given arrangement or span of bridged valves. In other words, a given valve bridge for a first engine family with a first valve assembly cannot be used for a different engine family and valve assembly where the valve span may differ. This means that different valve bridges must be manufactured for each configuration of valves across a sample of different actuation assemblies and engine families, which adds to cost.

There is thus a need for valve system components and valve systems that address the aforementioned shortcomings and others in the prior art.

SUMMARY

According to aspects of the disclosure, an example system for actuating engine valves may include a valve bridge that includes a main event rocker interface portion, a first valve interface portion and a second valve interface portion extending in generally opposite directions from the main event rocker interface portion. The first valve interface portion may include a valve pocket for engaging a stem of a first valve. The second valve interface portion may include an open end having a slot for receiving a bridge pin, which engages the stem of a second valve. The bridge pin may be actuated by an auxiliary motion source, such as a rocker arm or a master/slave hydraulic system.

One particular advantage of actuating systems and valve bridges according to the disclosure is that the valve bridge can be removed from the valve train without requiring removal of other actuation system components, such as auxiliary rockers or main event rockers. The slot and other features of the valve bridge, including the shape of the valve pocket and a contoured lower surface, permit the valve bridge to be moved in a lateral direction, away from the second valve stem and bridge pin, such that the valve bridge can be removed from the actuation system without removal of the main event rocker or other actuating components, such as an auxiliary rocker.

Another particular advantage of actuating systems and valve bridges according to the disclosure is that a single valve bridge configuration can be used with different valve spans, which may occur among different cylinder sizes in a given engine family, or across different engine families. The open end of the valve bridge and the extent of the slot permit variable mounting of the associated bridge pin and thus use of a given valve bridge with different valve spans.

DESCRIPTION OF THE DRAWINGS

The above and other attendant advantages and features of the invention will be apparent from the following detailed description together with the accompanying drawings, in which like reference numerals represent like elements throughout. It will be understood that the description and embodiments are intended as illustrative examples and are not intended to be limiting to the scope of invention, which is set forth in the claims appended hereto. The following FIGURES depict example devices and systems according to aspects of the disclosure.

DETAILED DESCRIPTION

Figure 1:
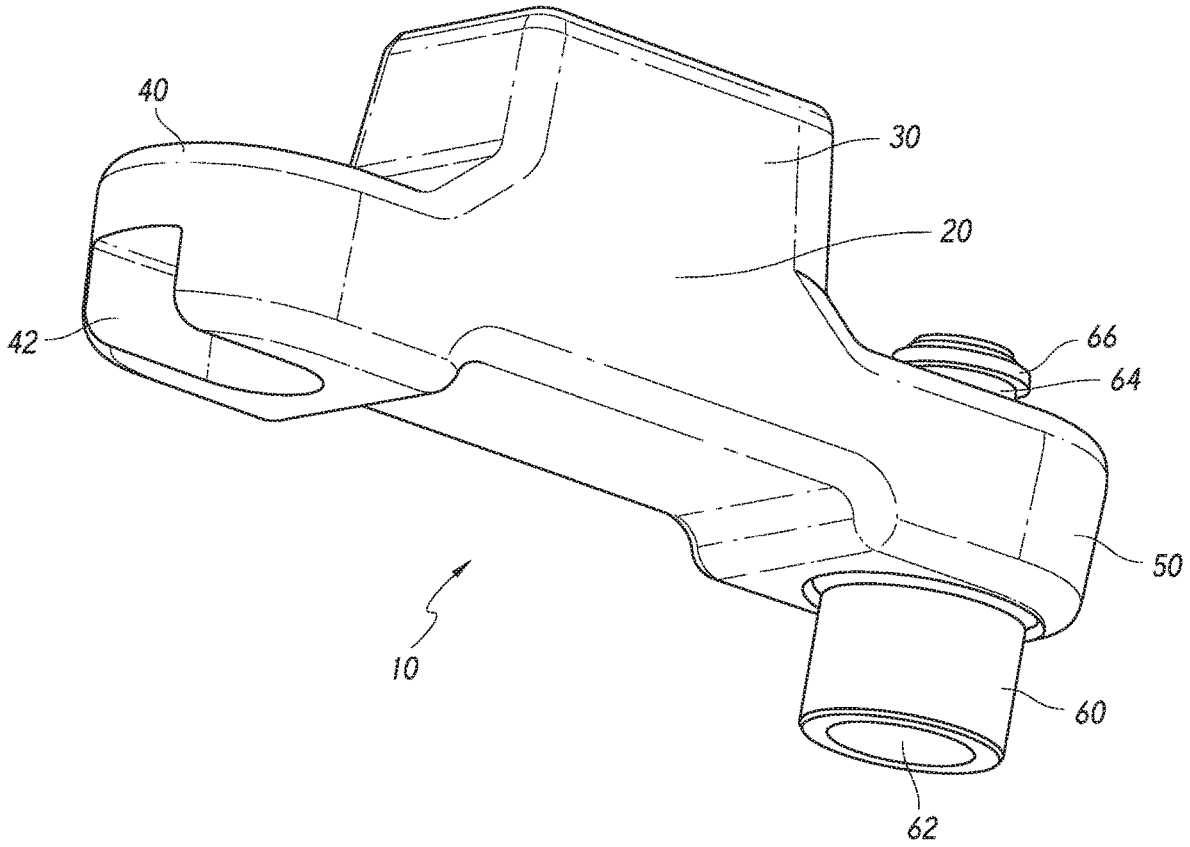
FIG. 1 (Prior Art)
FIG. 1 is a perspective view of a prior art valve bridge and bridge pin assembly, as discussed above.

An example valve bridge and actuation system according to aspects of the disclosure will now be described with initial reference to FIGS. 2, 3A, 3B, 3C and 4. The directional terms "longitudinal," "transverse" and "vertical" will be used herein and are illustrated by the orthogonal axes "L," "T" and "V" in FIG. 3A. The valve actuation system 100 may include a valve bridge 200, which may include a main event rocker interface portion 210 for receiving motion from a main event rocker 110 which, along with auxiliary rocker 140 as an auxiliary motion source, may be mounted for pivoting movement on a rocker shaft 112. As an alternative to the auxiliary rocker 140, the auxiliary motion source may include a master/slave hydraulic system, for example. Extending in generally opposite longitudinal directions from the main event rocker interface portion 210 is a first valve interface portion 220 and second valve interface portion 240. As shown, the main event rocker interface portion 210 comprises a substantially flat (i.e., within manufacturing tolerances) upper surface 212 configured to contact the main event rocker 110. In an embodiment, the flat upper surface 212 is broader or wider (along a longitudinal direction of the valve bridge 200) than a corresponding contact surface of the main event rocker 110 (e.g., the elephant foot 113 illustrated in FIG. 2). In this manner, use of the valve bridge 200 with engines having differing engine valve spans is facilitated because the flat upper surface 212 provides a suitable interface with the main event rocker 110 regardless of any lateral displacement of the valve bridge 200 required to bridge differing engine valve spans.

Figure 3A:
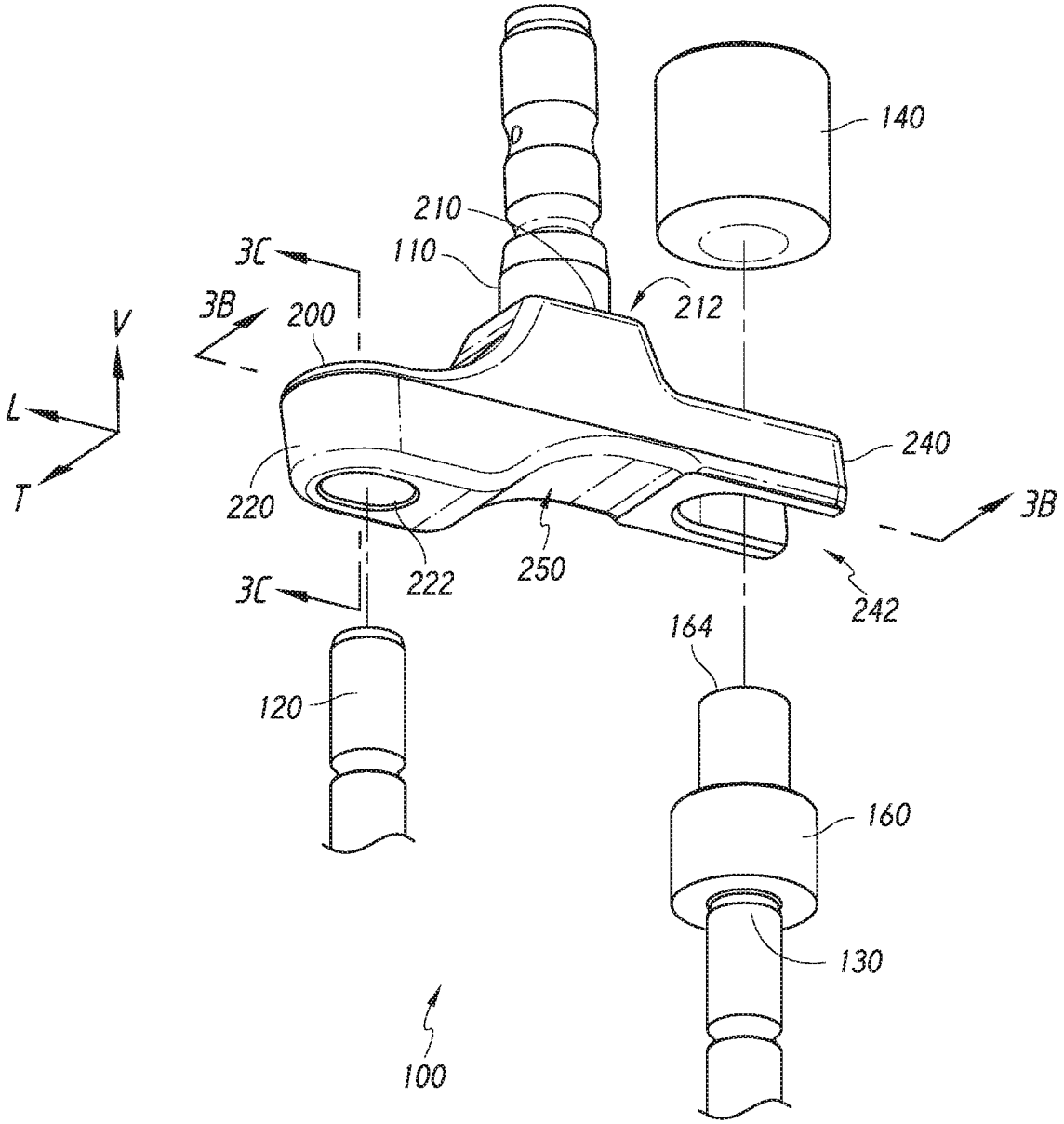
FIG. 3A shows a subset of components of the valve actuation system depicted in FIG. 2 and FIGS. 3B and 3C are sections taken along lines B-B and C-C, respectively.
Figure 3B:
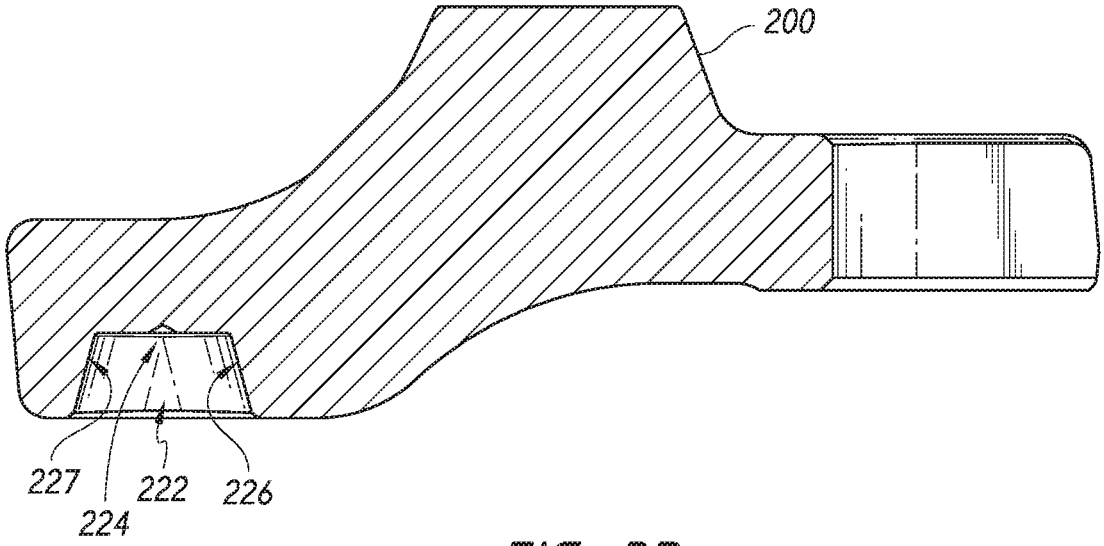
Figure 3C:
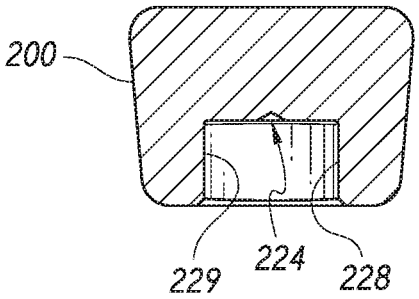

First valve interface portion 220 may include a pocket 222, which according to aspects of the disclosure, may have a generally tapered shape, formed therein. Referring additionally to FIGS. 3B and 3C, pocket 222 may include a valve stem end contacting surface 224 and opposing tapered end walls or surfaces 226 and 227, which provide suitable clearance and permit slight rotational movement, i.e., yaw, of the valve bridge 200 relative to the valve stem 120 during operation. Referring to FIG. 3C, pocket 222 may also include opposing transverse walls or surfaces 228 and 229, which provide for very limited to no transverse movement of the valve bridge 200 relative to the valve stem 120. Pocket 222 may be in direct contact with the end of a stem of a first valve 120 and may be sized such that the dimension of the valve stem end contacting surface 224 is complementary to the diameter of the valve stem. The tapered shape of pocket 222 thus provides for angular movement of the valve bridge 200 relative to the valve stem during operation and, in addition to other features of the valve bridge, facilitates easy removal. The opposing transverse walls 228 and 229 and the dimension defined therebetween form a close fit with the valve stem 120 and thereby increase stability of the valve bridge 200 during operation.

According to an aspect of the disclosure, a second valve interface portion 240 of valve bridge 200 may include an open end 242 having a slot 244 defined between two prongs 245, which may be sized to receive the post 164 of bridge pin 160. Generally flat surfaces 270 and 272 on the lower side of prongs 243 and 245 engage a shoulder 162 of the bridge pin 160. Second valve interface portion 240 is cooperatively associated with second valve 130. Respective coil springs 122 and 132 bias valves 120 and 130 in a closed position within the combustion chamber and upward against the valve bridge 200. Coil springs 122 and 132 are not shown in FIG. 3 in order to reveal further details of the valve bridge 200. Open end 242 permits longitudinal movement (i.e., in the direction of the span between valves 120 and 130) of the valve bridge 200 relative to the bridge pin 160 and second valve 130. Open end 242 permits relative movement between the valve bridge 200 and bridge pin 160 in a longitudinal direction and also permits removal of the valve bridge 200 from the bridge pin 160 by longitudinal movement. The term "open end" as used herein means any structure that permits the valve bridge 200 to be removed from the bridge pin 160 while the bridge pin 160 remains in place on the stem of valve 130. Thus, "open end" encompasses slots that extend in directions other than a longitudinal direction, such as slots that extend transversely and orthogonally to the longitudinal direction defined by the span of the valves, for example. As will be further explained, the open end 242 and the permitted longitudinal movement of the valve bridge provide for easy removal without requiring removal of other components, such as the main event rocker 110 or auxiliary rocker 140. As best illustrated in FIG. 3, a width of the slot 244 (i.e., in a direction perpendicular to the longitudinal axis of the valve bridge 200) is configured to permit movement of the post 164 within the slot, but to also engage a shoulder formed in the bridge pin 160 between the post 164 and the lower portion of the bridge pin 160. Additionally, a length of the slot 244 (i.e., in a direction parallel to the longitudinal axis of the valve bridge 200) is configured to accommodate the smallest and largest spans between engine valves intended for the valve bridge 200. For example, in the case of the smallest intended valve span between valves 120, 130, the bridge pin 160 will engage the slot 244 at a location along the slot closest to the closed end of the slot 244. On the other hand, the largest intended valve span between valves 120, 130, the bridge pin 160 will engage the slot 244 at a location along the slot closest to the open end 242.

Figure 2:
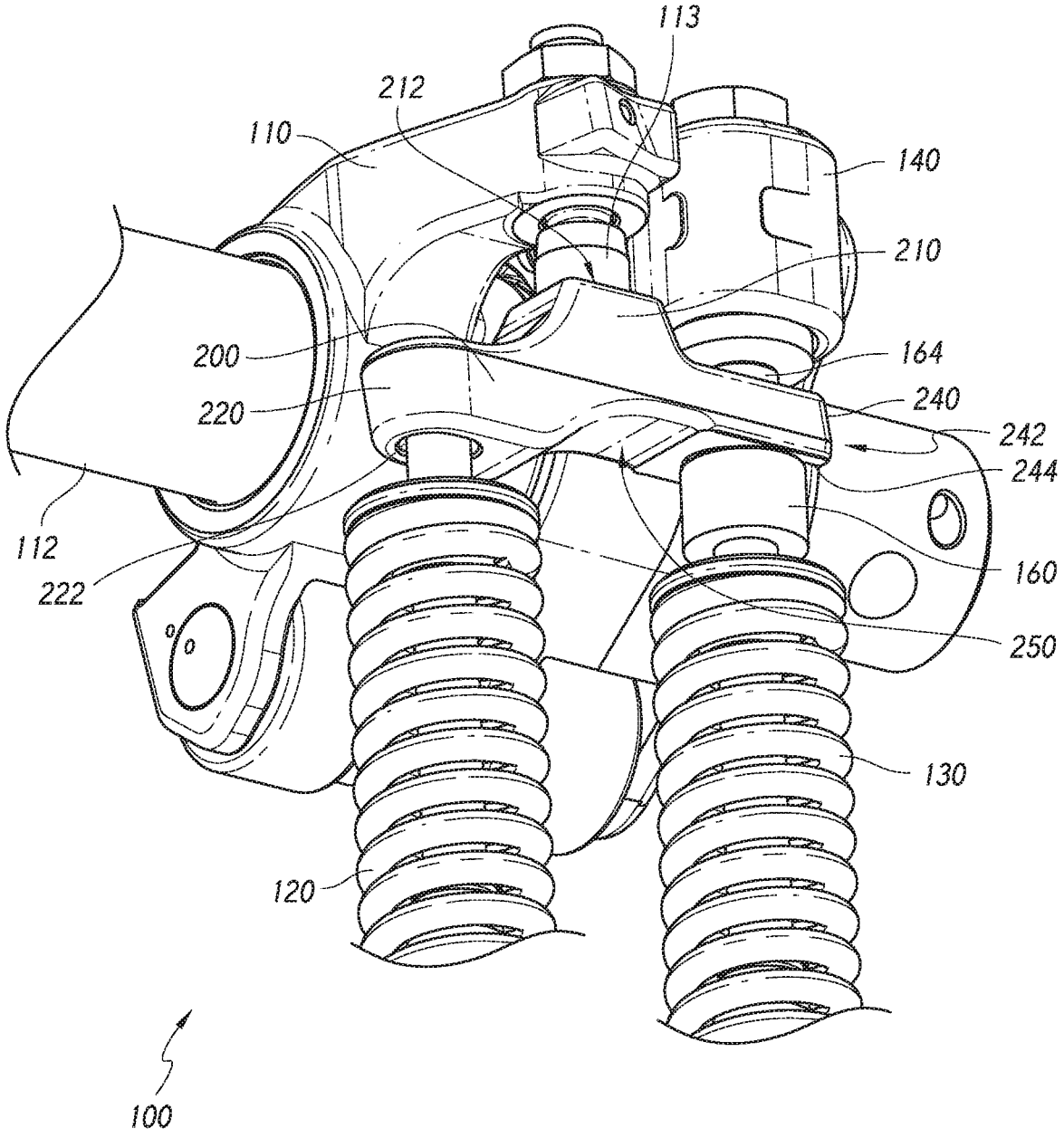
FIG. 2 is a perspective view of an example valve actuation system including an example valve bridge according to an aspect of the disclosure.
Figure 4:
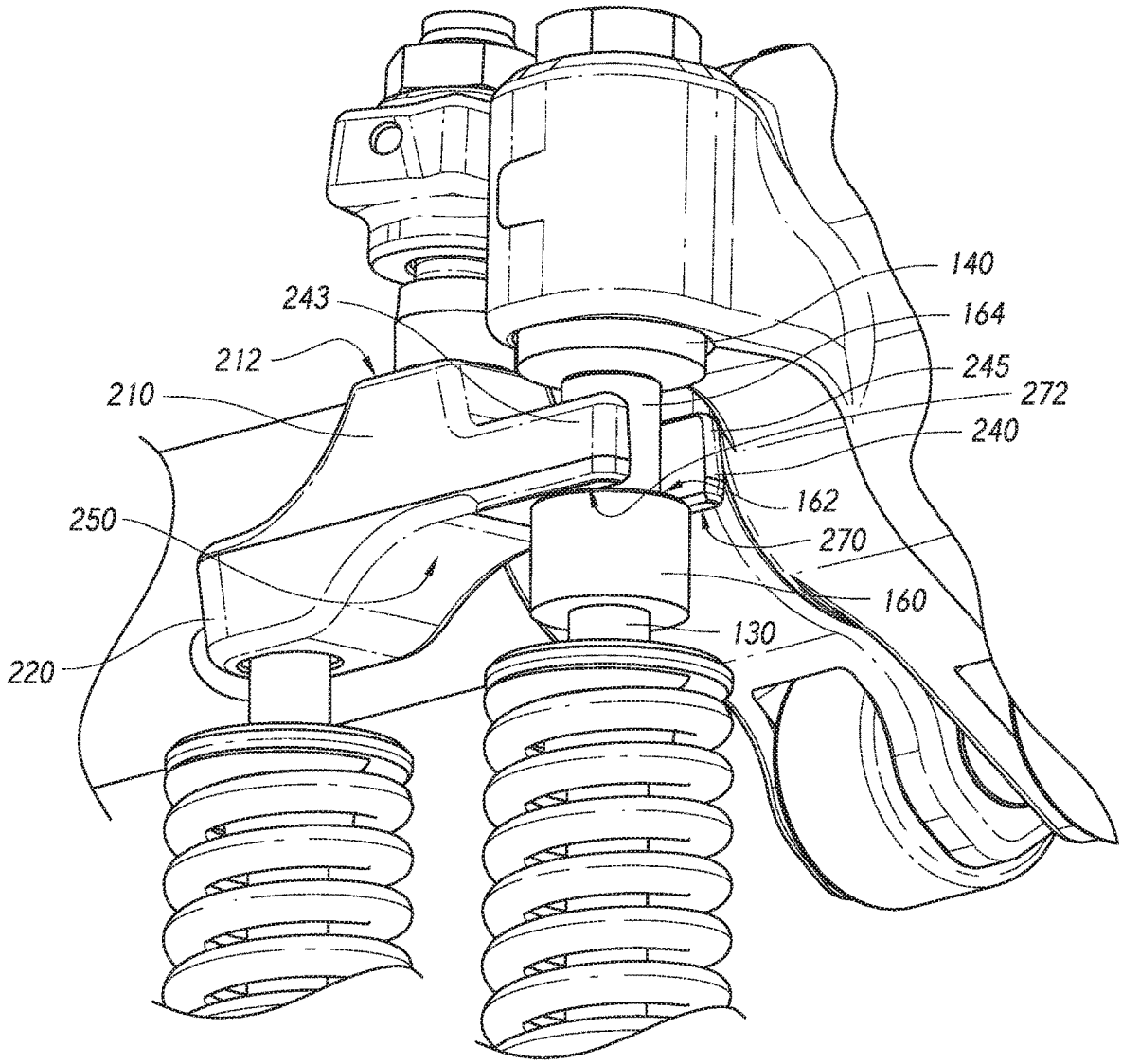
FIG. 4 is an additional perspective of the example valve actuation system of FIG. 2.

As is also apparent in FIGS. 2-4, valve bridge 200 may include respective thickness dimensions and offsets for the first valve interface portion 220 and second valve interface portion 240 which provide for easy removal. More particularly, the thickness of the open end 240, as measured in a direction parallel to the valve axes may be decreased compared to the thickness of the first valve interface portion, and the dimensions of the bridge pin 160 selected appropriately so in order to further facilitate ease of removal of the valve bridge. A contoured arcuate transition surface 250 extending from the first valve interface portion 220 to the second valve interface portion 240 on a lower surface of the valve bridge may also be provided to facilitate clearance of the stem of first valve 120 and other components during removal.

Figure 5:
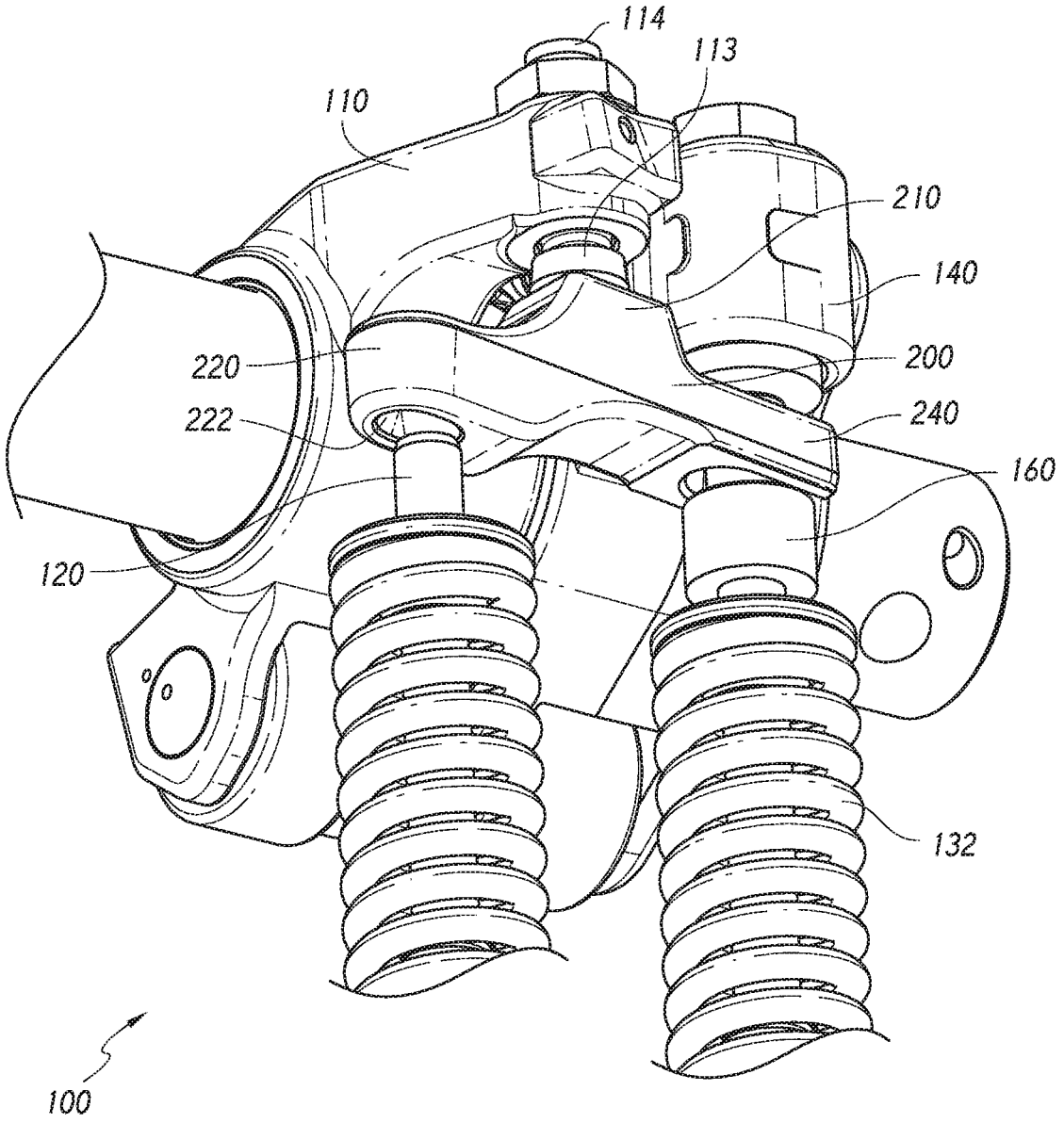
FIG. 5 is a perspective view of the valve actuation system of FIG. 2 showing a first removal step for the valve bridge.
Figure 6:
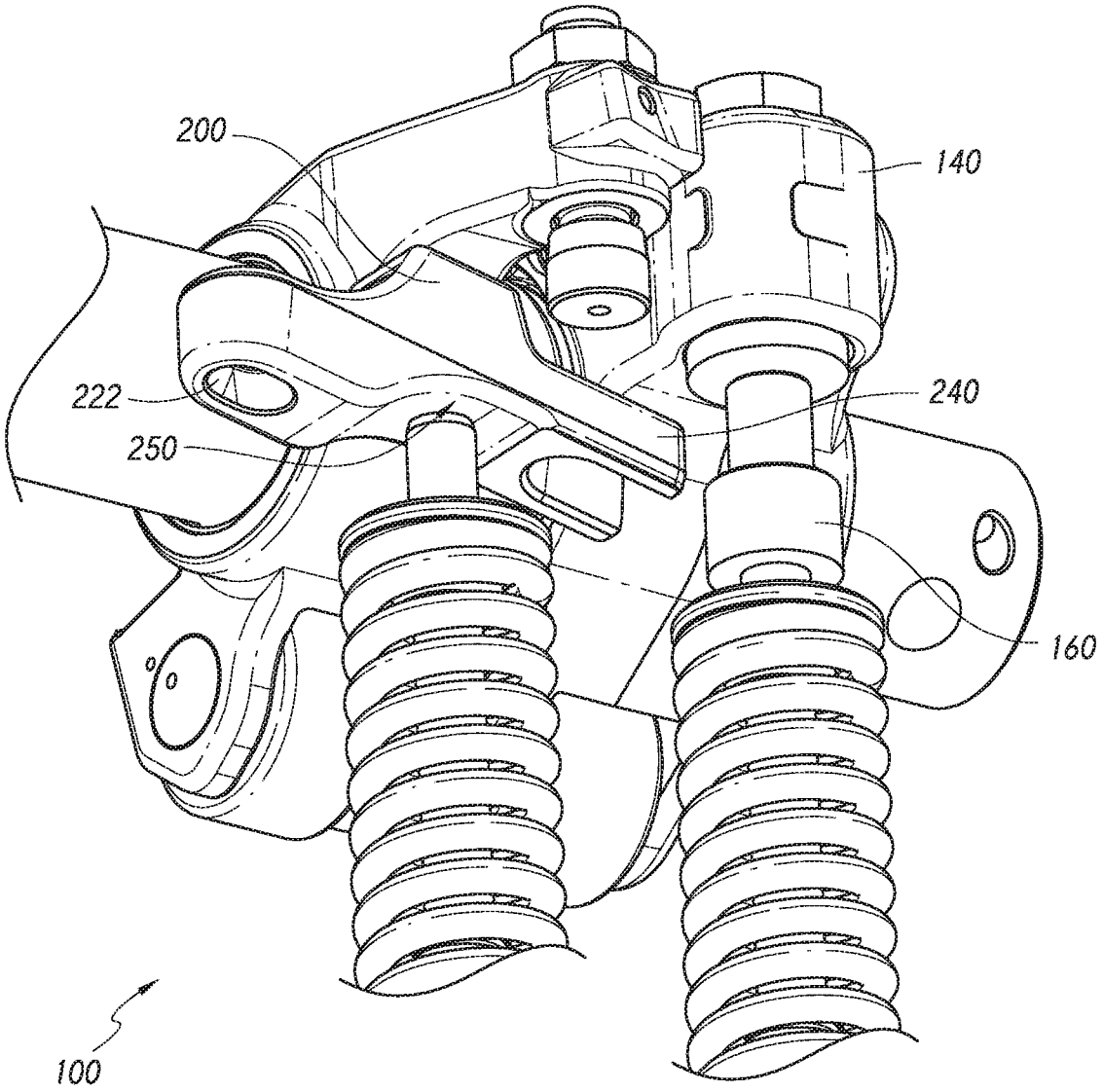
FIG. 6 is perspective view of the valve actuation system of FIG. 2, showing a second removal step for the valve bridge.

FIG. 5 is a perspective view showing the valve bridge 200 in a first removal position after a first removal step has been performed. In this step, a lash setting screw 114 has been loosened to create a gap between elephant foot 113 and the upper surface 212 on the main event rocker interface portion 210. This permits the first valve interface portion 220 of the valve bridge 200 to be displaced upward relative to the position shown in FIG. 2. First valve interface portion 220 may be displaced sufficiently to permit the end of valve 120 to clear the valve pocket 222. Further longitudinal movement of the valve bridge 200 to the position shown in FIG. 6 in which the bridge is slid away from under the auxiliary rocker and complete removal of the valve bridge 200 from the actuation assembly 100 may occur by virtue of the open end 242. As can be seen in FIG. 6, the contoured lower surface 250 provides for additional clearance of the end of stem of valve 120 during removal. Similarly, the decreased width dimension and offset of the second valve interface portion 240 compared to the first valve interface portion 220 provides for additional clearance during removal of the valve bridge 200. In addition, the tapered shape of the pocket 222 permits the valve bridge 200 to assume the orientation illustrated in FIG. 5, and clearance of the valve 120, during removal. As will be recognized, according to aspects of the disclosure, the removal of valve bridge 200 may be facilitated by setting the lash on the valve bridge to a higher than normal setting. Moreover, when the lash is set to a normal operating setting, the valve bridge is not removable.

Figure 7A:
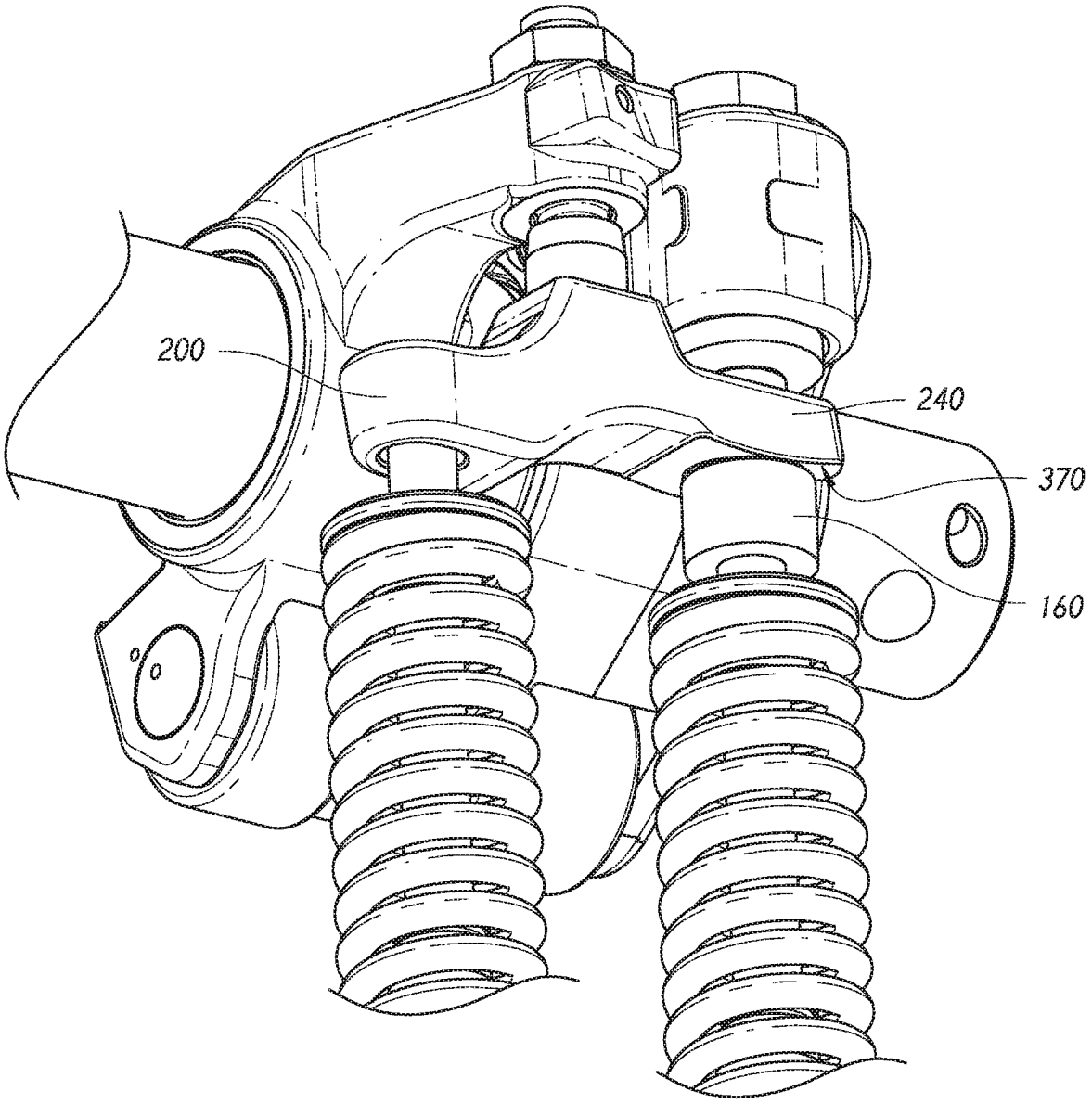
FIG. 7A is a perspective view.
Figure 7B:
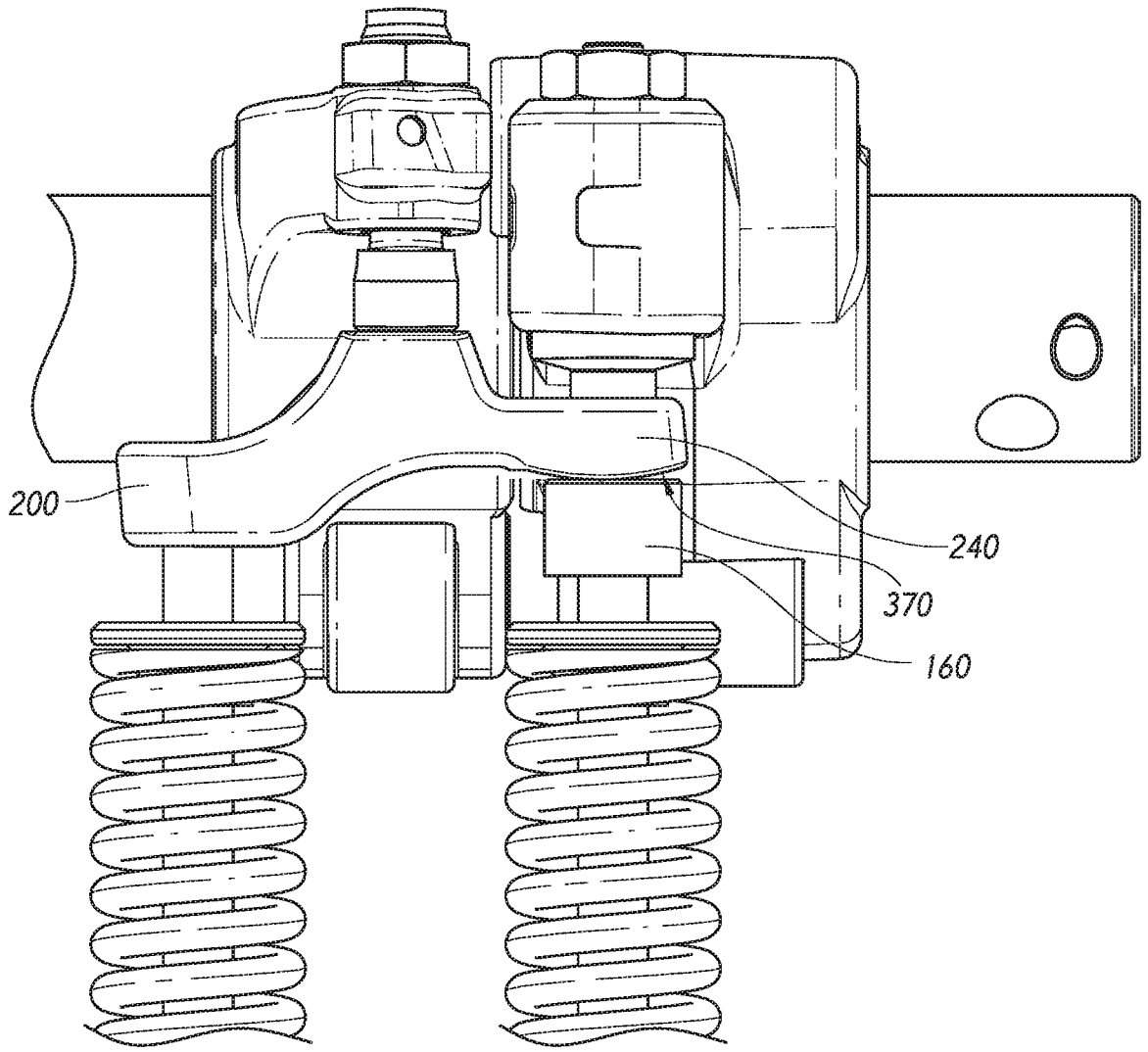
FIG. 7B is a side view of another example valve actuation system including a valve bridge with a curved actuating surface for engaging a bridge pin.

FIG. 7A is a perspective view and FIG. 7B s a side view showing another example valve bridge according to aspects of the disclosure. In this example, the valve bridge 200 is provided with curved actuating surfaces 370 on the prongs of the second valve interface portion 240. This configuration may prevent an edge loading condition between the bridge pin 160 and the valve bridge 200. The curved actuating surfaces 370 provide for improved wear on the bridge pin 160 during operation and permits a given valve bridge configuration to be used in more varied applications, i.e., across engine families having different sized (height) valves, without increased wear on the bridge pin 160 or valve bridge 200.

Although the present invention has been shown and described in detail the same is to be taken by way of example only and not by way of limitation. Numerous changes can be made to the embodiments shown without departing from the scope of the invention. The present invention may be further modified within the spirit and scope of this disclosure. The application is, therefore, intended to cover any variations, uses, or adaptations of the invention using its general principles. Further, this application is intended to cover such departures from the present disclosure as come within known or customary practice in the art to which this invention pertains.

The invention claimed is:

1. A system for actuating at least one of two or more engine valves in an internal combustion engine, the system comprising:

a main event rocker for actuating the two or more engine valves;

a valve bridge cooperating with the main event rocker for transmitting motion from the main event rocker to the two or more engine valves, the valve bridge including:

a main event rocker interface portion for receiving motion from the main event rocker;

a first valve interface portion extending from the main event rocker interface portion and including a first valve interface for transmitting motion to a first one of the two or more valves;

a second valve interface portion extending from the main event rocker interface portion and including a second valve interface for transmitting motion to a second one of the two or more valves;

the second valve interface portion including a slot extending to an open end of the valve bridge; and a bridge pin disposed in the slot for engaging an auxiliary motion source, the slot and open end arranged to permit removal of the valve bridge from the bridge pin.

2. The system of claim 1, wherein the auxiliary motion source is an auxiliary rocker arm for actuating the second one of the two or more engine valves and wherein the bridge pin transmits motion from the auxiliary rocker arm to the second one of the two or more valves.

3. The system of claim 1, wherein the auxillary motion source is a housing with an actuator piston for engaging the bridge pin.

4. The system of claim 1, wherein the valve bridge includes a contoured lower surface extending from the first valve interface portion to the second valve interface portion, the contoured lower surface adapted to accommodate a stem of the first valve when the valve bridge is displaced from the bridge pin, thereby permitting removal of the valve bridge.

5. The system of claim 1, wherein motion of the first valve defines a valve motion direction and wherein a thickness of the open end, as measured in the valve motion direction is less than a thickness of the first valve interface portion, as measured in the valve motion direction.

6. The system of claim 1, wherein the first valve interface portion includes a valve pocket for receiving an end of the first valve, the valve pocket having a depth that prevents removal when a lash setting on the valve bridge is within a normal operating range and permits removal when the lash setting on the valve bridge is greater than the normal operating range.

7. The system of claim 1, wherein the second valve interface portion includes at least one curved bottom surface for engaging the bridge pin.

8. The system of claim 1, wherein the first valve interface portion includes a tapered valve pocket having tapered opposing end walls and parallel transverse walls to permit rotation of the valve bridge relative to a stem of the first valve.

9. The system of claim 1, wherein the main event rocker interface portion includes a substantially flat surface having a width extending in a longitudinal direction and wherein the main event rocker includes a contact surface for contacting the flat surface, the contact surface having a width extending in the longitudinal direction, the main event rocker interface portion flat surface width being substantially greater than the main event rocker contact surface width to permit contact between the main event rocker interface portion and the main event rocker contact surface at different longitudinal positions of the valve bridge corresponding to different spans between the first and second valves.

10. A valve bridge for transmitting motion from a main event rocker arm to at least two valves in an internal combustion engine comprising:

a main event rocker interface portion for receiving motion from the main event rocker;

a first valve interface portion extending from the main event rocker interface portion and including a first valve interface for transmitting motion to a first one of the at least two valves;

a second valve interface portion extending from the main event rocker interface portion and including a second valve interface for transmitting motion to a second one of the at least two valves;

the second valve interface portion including an open end; and a bridge pin disposed in the open end, the second valve interface portion open end permitting removal of the bridge from the bridge pin by movement of the bridge in a longitudinal direction defined between the first valve interface portion and the second valve interface portion.

11. The valve bridge of claim 10, wherein the open end includes a slot extending within the second valve interface portion.

12. The valve bridge of claim 10, further comprising a contoured lower surface extending from the first valve interface portion to the second valve interface portion, the contoured lower surface adapted to accommodate a stem of the first valve when the valve bridge is displaced from the bridge pin, thereby permitting removal of the valve bridge.

13. The valve bridge of claim 10, wherein motion of the first valve defines a valve motion direction and wherein a thickness of the open end, as measured in the valve motion direction, is less than a thickness of the first valve interface portion, as measured in the valve motion direction.

14. The valve bridge of claim 10, wherein the open end includes a slot extending in the longitudinal direction.

15. The valve bridge of claim 10, further comprising a tapered valve pocket defined in the first valve interface portion.

16. The valve bridge of claim 10, further comprising a flat surface on the main event rocker interface portion for engaging a contact surface on the main event rocker.

17. The valve bridge of claim 10, wherein the second valve interface includes a bridge pin engaging surface for engaging the bridge pin and wherein the first valve interface includes a valve stem end contacting surface, the bridge pin engaging surface being offset from the valve stem end contacting surface.

18. The valve bridge of claim 10, further comprising a valve pocket defined in the first valve interface portion, the valve pocket including opposing tapered end walls, which are adapted to permit angular movement of the valve bridge relative to valve stem disposed therein and opposing transverse walls, which are adapted to form a close fit with the valve stem.

19. A system for actuating at least one of two or more engine valves in an internal combustion engine, the system comprising:

a main event rocker for actuating the two or more engine valves;

a valve bridge, cooperating with the main event rocker for transmitting motion from the main event rocker to the two or more engine valves, the valve bridge including:

a main event rocker interface portion for receiving motion from the main event rocker;

a first valve interface portion extending from the main event rocker interface portion and including a first valve interface for transmitting motion to a first one of the two or more valves;

a second valve interface portion extending from the main event rocker interface portion and including a second valve interface for transmitting motion to a second one of the two or more valves;

the second valve interface portion including a slot defined between two prongs and, each prong having a bridge pin engaging surface; and a bridge pin having a post disposed in the slot and a shoulder engaged by the bridge pin engaging surfaces, the bridge pin post extending through a top surface of the valve bridge.

* * * * *